United States Patent [19]

Claxton et al.

[11] 4,360,161

[45] Nov. 23, 1982

[54] ELECTROMAGNETIC FUEL INJECTOR

[75] Inventors: William B. Claxton, Bloomfield; Gary L. Casey, Troy; Albert Blatter, Southfield; John A. Miller, Auburn Heights, all of Mich.

[73] Assignee: The Bendix Corporation, Southfield, Mich.

[21] Appl. No.: 210,976

[22] Filed: Nov. 28, 1980

Related U.S. Application Data

[63] Continuation of Ser. No. 7,444, Jan. 29, 1979, abandoned.

[51] Int. Cl.[3] ..... B05B 1/34

[52] U.S. Cl. ..... 239/463; 239/585

[58] Field of Search ..... 239/585, 399, 463, 403; 251/139, 140, 129

[56] References Cited

U.S. PATENT DOCUMENTS

| | | | |
|---|---|---|---|
| 3,949,938 | 4/1976 | Goodinge | 239/585 X |
| 4,101,074 | 7/1978 | Kiwior | 239/585 |

FOREIGN PATENT DOCUMENTS

| | | | |
|---|---|---|---|
| 2508390 | 9/1976 | Fed. Rep. of Germany | 239/585 |
| 1048735 | 11/1951 | France | 239/585 |
| 1541458 | 10/1967 | France | 239/585 |
| 1553610 | 12/1968 | France | 239/399 |
| 2355174 | 6/1977 | France | 239/585 |
| 7809437 | 3/1978 | France | 239/585 |
| 2013778 | 1/1979 | United Kingdom | 239/585 |

*Primary Examiner*—John J. Love
*Assistant Examiner*—Gene A. Church
*Attorney, Agent, or Firm*—Russel C. Wells

[57] ABSTRACT

A high flow rate electromagnetic fuel injector valve with a rapid response time is disclosed for utilization in electronic fuel injection systems. The fuel injector valve comprises a stator means and a valve assembly having a self-centering valve member reciprocally mounted in a valve housing. The valve member consists of a ball valve with a semispherical sealing surface connected by a stem to a magnetically attractable cup-shaped armature. The armature is preferably coated with a friction reducing material where it slideably contacts an armature guide bore of the injector valve during its reciprocation. The ball valve of the valve member obturates an exit orifice of the valve housing by sealing against a conical valve seat which has been coined to receive it. Adjacent to the ball valve and conical valve seat interface are vortex generating and metering orifices for the tangential entry of fuel into a swirl chamber of the valve housing. The positioning of the metering orifices, which are precisely sized by ballizing to control flow rate, is used to regulate the injector spray angle generated by the vortex of fuel entering the swirl chamber. The conical surface of the valve seat produces vortex amplification to further increase the swirl effect caused by the positioning of the entry orifices.

11 Claims, 10 Drawing Figures

120
118
121
130
122
126
110
112
104
139
103
124
114
132
100
140
138
116
128
136
135
137
147
101
141
102
161
108
142
106
162
145
160
144
159
148
27
164
149b
151
150
3
3
149a
165
154
146

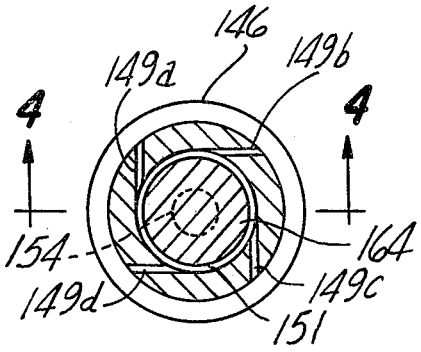
Fig-3
Fig-4
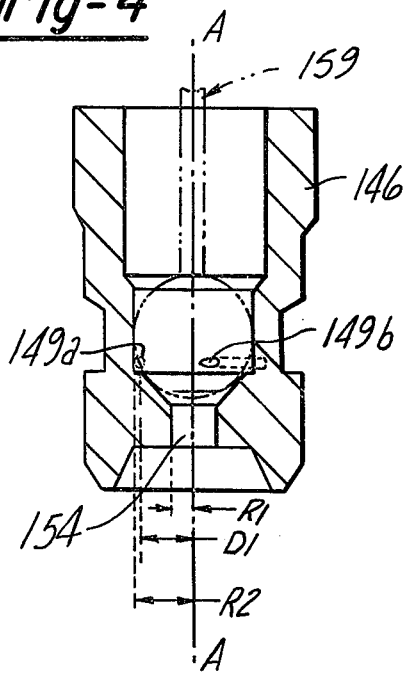
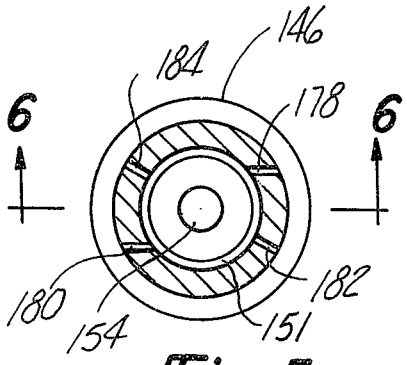
Fig-5
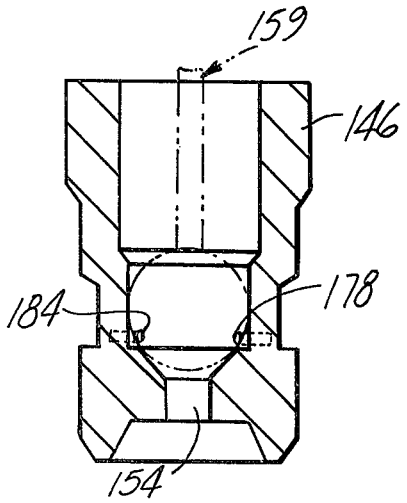
Fig-6

ELECTROMAGNETIC FUEL INJECTOR

This is a continuation of application Ser. No. 7,444, filed Jan. 29, 1979 now abandoned.

BACKGROUND OF THE INVENTION

Field of the Invention

The invention pertains generally to electromagnetic injector valves and is more particularly directed to a fast acting high flow rate injector valve with predictable fuel spray pattern.

Electromagnetic fuel injection valves are gaining wide acceptance in the fuel metering art for both multi-point and single point systems where an electronic control apparatus produces a pulse width signal representative of the quantity of fuel to be metered into an internal combustion engine. The injectors operate to open and close pressurized fuel metering orifices leading to the air ingestion paths of the engine by means of a solenoid actuated armature responding to the electronic signal. The quantity of fuel injected can then be precisely tailored to the operating conditions of the engine by controlling the fuel pressure, orifice size, and the duration of the injector on time. Because of recent advances, electromagnetic injectors are becoming very precise in their metering qualities and very fast in their operation. With these advantages the electromagnetic fuel injector valve will continue to assist the advances in electronic fuel metering which have improved economy, reduced emissions, and aided the driveability of the internal combustion engine.

Present electromagnetic injectors are usually divided into two sections wherein the first section or the stator means generates a magnetic force to control the second section or the valve assembly which meters the fuel. The two sections are operably coupled by a magnetically attractable armature physically connected to a valve member. The valve member is normally biased against a valve seat by a closure spring in an off mode and opens in response to the magnetic force.

Many of these injector valves have fuel under pressure input to an entry port at the stator end of the injector. The fuel then flows by a generally concentric central path through the body of the injector to the valve assembly. These structures are usually termed "top feed" injectors. Other injector structures have been made whereby lower pressures of input fuel may be made to the valve assembly end. These structures are usually termed "bottom feed" injectors. The lower fuel pressure of the "bottom feed" injector reduces the demand for a more expensive fuel pump and pressurizing system which is necessitated in the "top feed" injector. Further, with a "bottom feed" injector, more flexible mounting procedures may be used to advantage. It is known that such "bottom feed" injectors can be utilized either in single point or multi-point systems.

Examples of "bottom feed" injectors and their mounting structures in two advantageous single point systems are found in U.S. Pat. Ser. No. 956,693 filed on Nov. 1, 1978 in the name of W. B. Claxton, and U.S. Ser. No. 875,832 filed on Feb. 7, 1978 in the name of G. L. Casey; both of which applications are commonly assigned to the assignee of the present application and the disclosure of which is hereby expressly incorporated herein by reference.

These injectors meter fuel by the length of time that the valve mechanism is open and have a static fuel flow rate dependent upon the size of the exit orifice. Relatively small changes in the metering orifice size can substantially change the flow rate of the injector and thus the exit orifice size must be precisely controlled. Claxton discloses a means by which the static flow rate of the fuel injector may be tailored after assembly without reboring the exit orifice if it is off-sized. Still other injectors have prior to this been expensively remanufactured if the static flow rate is out of tolerance.

Even with this flow rate trim, the Claxton injector after normal use may deviate from its calibrated static fuel rate. Contaminants from evaporating fuel and foreign particles in the air flow may lodge in the exit orifice of the injector creating a modification to the flow rate. There is nearly always some contamination build-up on the injector tip after extensive use in hostile engine environment. This is especially true in a low pressure "bottom feed" injector where the force of the fuel through the exit may not be enough to clean contamination and debris from the exit orifice. It would, therefore, be highly desirable to obtain the advantages of an injector trim and orifice metering while not basing the injector flow rate on the exit orifice diameter which can change with contamination.

Further, Claxton discloses a fast-acting valve which can be dynamically cycled into the millisecond range because of its low mass armature and needle valve combination. Another low mass armature and the needle combination is illustrated in a U.S. application Ser. No. 940,522 filed on Sept. 8, 1978 in the names of J. C. Cromas, et al. and assigned commonly to the assignee of the present application, the disclosure of which is hereby expressly incorporated herein by reference.

Although these injector valves have armature and needle valve combinations which are particularly low in mass and work well, they do require machining of the bearing surfaces of their medial sections to produce the desired results. Highly machined and smooth medial sections are required because the bearing surfaces must slide concentrically to center the valve member into a conical valve seat securely for sealing purposes.

Another fuel injector having a low mass armature and valve member combination is disclosed in a U.S. Pat. No. 4,030,688 issued in the name of A. M. Kiwior on July 21, 1977 and which is commonly assigned with the present application. Kiwior discloses the use of a ball valve on the end of a flexible stem mating with a conical valve seat that has been coined. The armature and valve member combination of this injector also utilizes bearing surfaces on the medial section for guiding purposes, although it has a self-centering valve. Therefore, this injector valve member and armature combination is fairly complicated in structure primarily suitable for a "top feed" injector. It would be desirable to provide an "end feed" injector with a low mass valve member and armature combination that is self-centering and does not necessitate highly machined bearing surfaces on its medial section.

While all of the injectors discussed to this point can be used in either single point or multi-point applications, it appears that single point applications will become more and more prevalent. One such single point system gaining in popularity today requires electromagnetic injector that is mounted above the throttle blade of the air ingestion path for the internal combustion engine. When mounted in such a manner, the most desirous spray pattern for the injector is either full atomization or a wide angled "hollow cone" type of pattern. The hollow cone spray pattern is termed such because much of the injected fuel is contained between an inner and outer cone angle which have their apexes substantially at the point of injection. The hollow cone pattern is advantageous in above throttle blade injection because it does not wet the sides of the throttle bore or the throttle plates substantially and directs the fuel into the turbulent air between the throttle blade and bore wall for excellent mixing and atomization prior to engine ingestion.

One of the methods of generating a wide angle spray is to generate a swirling or a vortex from the fuel injector which spreads the fuel substantially uniformly between the angles desired. In the application by Claxton a number of vortex generation techniques that are useful to provide wide angle sprays are disclosed. Further, U.S. Pat. No. 3,241,168 issued to Croft illustrates a swirl generation means with a swirl chamber in an electromagnetic fuel injector.

Croft and Claxton, however, generate wide angled spray patterns that are difficult to control at lower pulse widths for the injectors. Both references have swirl chambers that have relatively large residual volumes when the injector is off. When the injector is opened there is a delay before the spray pattern is regenerated and the vortex can be built up. Croft attempts to solve this problem by using a complicated recirculation path to continaully move fuel through the swirl chamber when the valve is closed. These injectors also meter fuel with their exit orifices which, as has been explained before, makes them subject to contamination problems. The valve members of these injectors further extend into the valve seats a substantial length and this extension tends to disturb the vortex generated therein. The swirling fuel tends to drag along the surfaces of the valve tip and lose momentum.

It would, therefore, be desirable not only to provide an injector with a swirl chamber having a minimum residual volume, but also one including an injector valve member that does not extend substantially into the valve seat.

Since one would prefer an injector structure that could be used in either single or multipoint injection and a multiplicity of both types of designs are being proliferated, it would be highly desirable to be able to control the spray angle of the injector in the preferred hollow cone pattern over a wide range. Generally, for single point applications the farther away from the throttle blade an injector is, the narrower the spray angle. Also, a very narrow spray angle can be utilized for most multipoint applications. Wider spray angles can be used for closer placement of the injector with respect to the throttle blade in many other single point applications.

Wide control of the spray angle with a single common structural element of the injector is difficult for a low pressure and high flow rate valve. One method of spray angle control is illustrated in the application by Cromas, et al. where a protected pintle that has a deflection surface perpendicular to the spray axis of the injector is used. The distance away from the exit orifice and the diameter of the deflection surface varies the spray angle over a wide range of injector pressures and flow rates. The deflectiodesirable to generate a controllable spray pattern over wide ranges of pressures and flow rates without the expense of the deflection pintle.

SUMMARY OF THE INVENTION

A high flow rate electromagnetic injector valve with a rapid response time is provided by the invention. The injector valve comprises an electromagnetic stator means and a valve assembly. The valve assembly includes a valve housing in which a valve member is reciprocally mounted for opening and closing an exit orifice. The valve member seats against a valve seat connecting a central valve housing bore to the exit orifice. Fuel under pressure enter the valve housing bore via a plurality of entry orifices proximate to the valve member and valve seat interface to provide a low pressure "bottom feed" injector.

According to one aspect of the invention the entry orifices are precisely sized to meter fuel into the exit orifice. The precision sizing of the entry orifices is accomplished by ballizing each orifice to a precise diameter. This feature allows the "bottom feed" injector to retain its calibrated static fuel flow rate even in the face of contamination of the exit orifice.

The bottom feed injector valve assembly is provided with a valve member comprising a ball valve that has at least semi-spherical sealing surface and which is attached to a cup-shaped armature means via a stem member. The valve member mates with a conical valve seat which, preferably, has been coined with a larger semi-spherical surface to form a self-seating valve along a circular sealing ridge of the coinment. This eliminates the need for the bearing surfaces on the medial section of the valve member to maintain the valve concentric against the seat. Thus, a low mass valve member which is self-centering is provided which enhances the actuation time of the injector.

The stator means includes a coil assembly with a central bore into which is mounted a core member containing an adjustment screw. The core member is located adjacent across an air gap from the cup-shaped armature of the valve assembly and the adjustment screw cooperates with a closure spring that biases the valve member against the valve seat. These two members provide an adjustable lift and closure force for the injector valve. The static flow of the entry orifices can further be trimmed by the adjustment of the core member when the lift is altered.

According to another aspect of the invention, the valve member is manufactured by resistance-welding a spherical ball valve to one end of a flexible stem member and welding at the other end a cup-shaped magnetic armature. The cup-shaped armature may be stamped as a cup or machined out of bar stock to produce a facile member for connection to the stem. Preferably, the armature may be coated by a friction reducing substance where it slideably contacts an armature guide bore of the valve housing during its reciprocation.

According to still another aspect of the invention, the spray pattern of the injector is controllable from a wide angle hollow cone spray pattern to a narrow pencil-like stream. The spray angle control is provided by positioning the fuel entry orifices with respect to a swirl chamber just upstream of the valve member and valve seat interface. The positioning controls the tangential component of fuel flow with respect to the axial component of flow.

The spherical valve and the conical valve seat cooperate to provide a minimum residual volume swirl chamber. A swirl chamber with a minimum residual volume will not vary the spray angle considerably over the wide variations of injector pulse widths necessary for single point injection. Thus, a very uniform spray pattern may be maintained over a considerable speed range of the engine. This will produce a more even fuel distribution, less condensation and wall wetting.

The swirl chamber is assisted by the conical surface of the valve seat which acts as a vortex amplifier to produce the desired spray angle. Since the ball valve does not extend significantly into the volume between the exit orifice and the conical valve seat, an amplification of the swirling effect takes place as the fluid is accelerated into the narrowing area of the valve seat.

In a first preferred embodiment, the positioning of the entry orifices is four orifices tangential to the swirl chamber. The spray angle of the injector is controlled by controlling the ratio of the cross-sectional areas of the entry orifices with respect to the exit orifice.

Another embodiment is shown in which the spray angle is controlled by modifying the positioning of the entry orifices such that the direction of fuel entry is varied between a tangential entry and a radial entry. The spray angle pattern is controlled by the amount of offset from the tangential position that the entry orifice has been moved.

Still another embodiment is shown where a combination of radial entry orifices and tangential orifices are used and whereby the spray angle is controlled by the ratio of the radial flow component as compared to the tangential flow component.

Yet another embodiment is shown wherein any one of the first three embodiments may include an angular offset from the horizontal to change the spray angle of the injector.

These and other features, advantages and aspects of the invention will be more fully understood and better explained if a reading of the detailed description is undertaken in conjunction with the appended drawings wherein:

DESCRIPTION OF THE DRAWINGS

FIGS. 3 and 4 are cross-sectional top and side views, respectively, of the injector valve housing illustrating the positioning of the entry ports for one embodiment of the invention;

FIGS. 5 and 6 are cross-sectional top and side views of an injector valve housing illustrating the positioning of the fuel entry ports for another embodiment of the invention;

DETAILED DESCRIPTION OF THE PREFERRED EMBODIMENT

Figure 1:
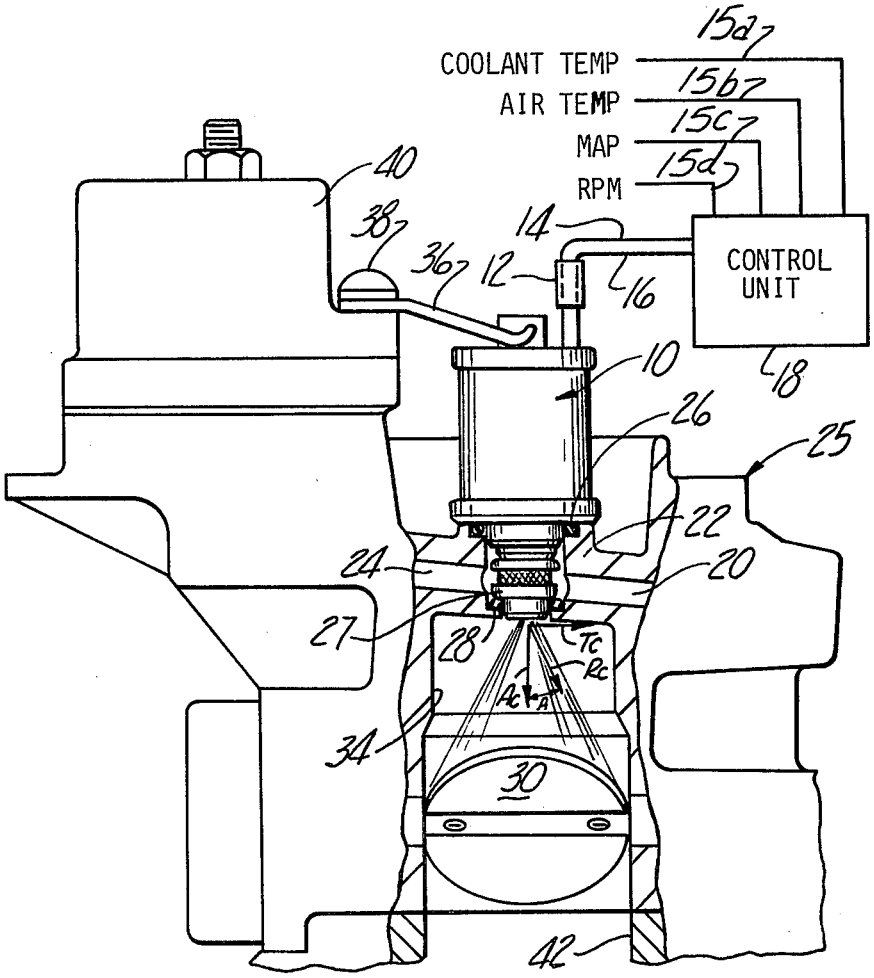
FIG. 1 is a partially sectioned side-view of a single point injection system with a high flow rate fast acting electromagnetic injector valve constructed in accordance with the invention.

With reference now to FIG. 1, there is shown an electronic single point fuel injection system for the metering of fuel to an internal combustion engine. The system comprises an electromagnetic injector valve 10 which is electrically connected by a pair of conductors 14,16, of a connector 12 to a control unit 18. A plurality of engine operating parameters can be input to the control unit 18 including the speed or RPM at which the engine is turning, the absolute pressure of the intake manifold (MAP), the temperature of the air ingested, (AIR TEMP), and the engine coolant temperature (COOLANT TEMP) by means of conventional sensors via input lines 15*a–d*.

The injector 10 fits within an injector fuel jacket 22 centrally located in a single air induction bore 34 of a throttle body 25 communicating with an intake manifold 42 of the internal combustion engine (not shown). For throttle bodies with multiple air induction bores, an injector per bore can be utilized. Air flow for engine ingestion is regulated by a conventional throttle plate 30 which is rotatably mounted below the injector jacket 22.

Upon the sensing of the operating conditions of the engine, the control unit 18 will calculate pulse width electronic injection signals representative of fuel quantity desired for injection and transmit them to the injector 10 through connector 12. The injector opens and closes relative to the leading and trailing edges of the pulse signal respectively to meter fuel from the injector jacket 22 into the incoming air flow.

The fuel is metered in a wide spray angle pattern for optimum mixture with the incoming air and delivery into the intake manifold. The wide spray or hollow cone pattern directs substantially all of the injected fuel between the area formed between the open throttle plate 30 and the bore 34.

Fuel under pressure is delivered to the injector jacket 22 by a fuel inlet 20 and is circulated through the interior of the injector jacket and thereafter to an exit passage 24 where a pressure regulator 40 maintains the systemic pressure constant. Spent fuel is returned to a reservoir, such as a fuel tank, where it can be pumped under pressure to the fuel jacket 22 once more.

The injector is sealed in the jacket by suitable resilient means, such as an O-ring 28 at the bottom end of the jacket, and an O-ring 26 resting against a shoulder at the top end of the jacket. The injector 10 is restrained in the jacket 22 against the O-rings by a spring clip 36 fixedly positioned by by a screw 38. A fuel filter 27 may be slip-fitted over the injector end to rest against the lower O-ring 28.

Such a single point fuel injection system as shown is particularly adaptable to run a 2.2 liter engine having four cylinders. By injecting twice every revolution or 180° of crankshaft movement, an air/fuel charge per each cylinder firing is obtained. The injection is preferably made at a predetermined angle relative to an engine event, such as just prior to top dead center (TDC) of the number 1 cylinder on the intake stroke, and thereafter cylicly related to that point. The injection timing of firing just before the opening of a particular intake valve allows much of the fuel and air charge to be transported to the particular cylinder injected. This reduces condensation and helps eliminate cylinder-to-cylinder distribution errors.

To inject a system as that described above, an injector with a high single point fuel rate of 400–600 $cm^3$/min. and with a dynamic characteristic linear into the one millisec range is needed. The invention provides such an electromagnetic injector valve 10 with an advantageous construction.

Figure 2:
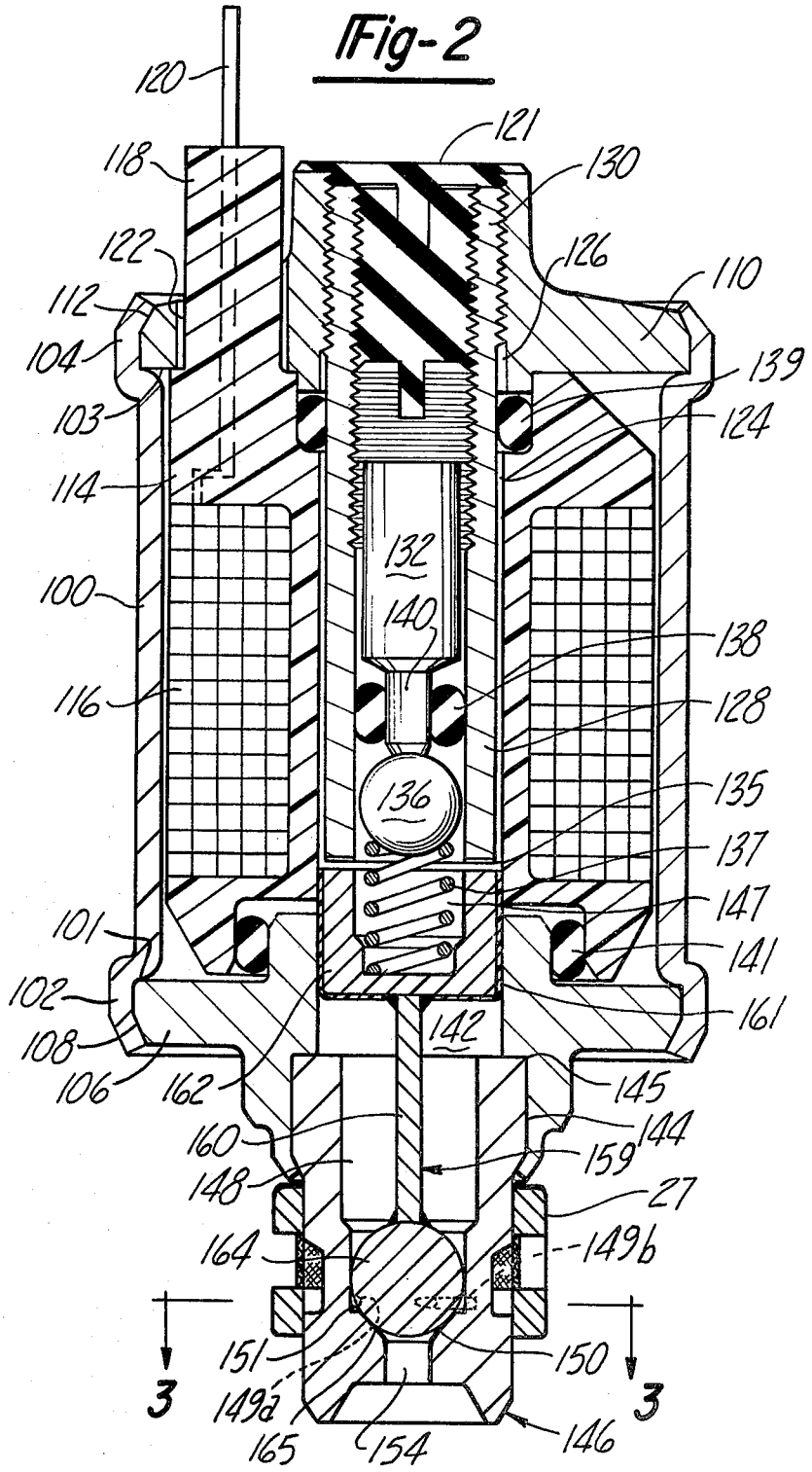
FIG. 2 is a cross-sectional side-view of the electromagnetic injector valve illustrated in FIG. 1.

With reference now to FIG. 2, the high flow rate injector valve 10 is shown in cross-section to advantage and comprises a tubular injector body 100 which may be constructed from seamed or unseamed tubing which has been cut to length. The injector body 100 is cold-formed at each end to form a shoulder 101 with a radially offset rim portion 102 at the front end and a shoulder 103 with another radially offset rim portion 104 at the rearward end. As the tubular body 100 is part of the magnetic circuit of the injector, the material used is preferably standard now carbon steel mechanical tubing. This material provides excellent mechanical strength and exhibits adequate magnetic permeability at low cost. The body 100, as well as all other outside surfaces of the injector valve 10, can be treated by conventional methods for corrosion resistance and environmental hazards.

A front end cap 106 has a centrally bored cylindrical body that is flanged to abut against the shoulder 101 and is fixed in position by crimping or swaging the rim 102 against a bevel 108 machined on the flange. Similarly, a rear end cap 110 comprising a centrally bored cylindrical body is flanged and abuts the shoulder 103 and is affixed thereat by deforming rim 104 to mate with a bevel 112 machined in the flange of the cap.

Within the chamber defined by the inner wall of the injector body 100 and the inwardly facing surfaces of the front end cap 106 and rear end cap 110, is a generally elongated molded bobbin 114 wound with a plurality of turns of magnet wire forming a coil 116. The coil 116 is electrically connected to a set of terminal pins 120 (only one shown) which rearwardly exit through an oval-shaped aperture 122 in the rear end cap 110 and are protected by a connector 118 integrally molded as part of the bobbin 114. The terminal pins 120 mate with suitable terminals of the connector 12 to electrically connect the injector to the control unit 18.

Bobbin 114 has a centrally located longitudinal bobbin bore 124 which is substantially coaxial with a threaded rear end cap bore 126. A rod-shaped core member 128 of a soft magnetic material is screwed into the threads of the end cap bore 126 and extends substantially the length of the bobbin bore. The core member 128 is sloted at its threaded end 130 to provide for adjustment of its extension into the bobbin bore 124. The adjustment of the core member determines the initial air gap distance and, hence, the lift of the valve. An adjustment screw 132 is threaded into an internal bore of the core member 128 to provide an adjustment of the valve closure force and time by means of a pin 140 moving against a spherical ball member 136.

The internal bore of the core member 128 is sealed by an O-ring 138 slipped over the pin 140 and sealing against the inner surface of the bore. The bobbin bore 124 is hydraulically sealed at the internal face of the rear end cap 110 by an O-ring 139 and the tubular body 100 is hydraulically sealed at the front end cap 106 by an O-ring 141.

Located in the central bore of the front end cap 106 is a single step dividing the bore into an armature guide bore 142 and a mounting bore 144. A valve housing 146 is received in the mounting bore 144 until it abuts the internal shoulder 145 formed at the step. The valve housing 146 is held in place by bending the front rim of the mounting bore 144 over a chamfer in the valve housing 146. The valve housing 146 has a centrally located longitudinal valve housing bore 148 which communicates on one end with the armature guide bore 142 and at the othe end is terminated with a conical valve seat 150 and a cylindrical exit orifice 154.

According to one aspect of the invention reciprocal in the valve housing bore 148 is a valve member 159 which comprises a flexible stem 160 connected at one end to a magnetically attractable cup-shaped armature 162 and at the other to a ball valve 164. The ball valve 164 has at least a semi-spherical sealing surface 165 which preferably mates against a coined portion of the conical valve seat 150. The valve seat 165 has been coined with a larger spherical surface to allow the ball valve 164 to seat against the lower circular edge of the coinment. Alternatively, the valve seat 150 may be conventionally lapped to where it forms a tight seal with the ball valve.

The spherical shape of the sealing surface 165 allows the valve member to seat against the valve seat 150 in a sure manner, even if the valve member closes slightly non-concentric. There may also be some slight flexing of the stem 159 to assist the seating of the ball valve 164 when it closes. This produces a self-centering valve without the necessity of the medial sections used in prior valves.

The cup-shaped armature 162 receives a closure spring 137 within an inner spring mounting recess 147 of the armature. Separating the armature 162 from the core member 128 is a working air gap maintained by the compression of the closure spring 137. The cup-shape of the armature 162 reduces eccentric forces from the closure spring 137 and provides an excellent magnetic path for enhancing the opening time of the injector valve.

The armature slideably contacts the armature guide bore 142 and is provided with a friction reducing material 161 along the surface of contact. Alternatively, the friction reducing material can be provided on the inner surface of the armature guide bore.

The friction reducing material 161 allows the armature to be guided in the armature guide bore easily with less of an air gap therebetween. A smaller air gap across the sliding contact area of the armature side walls will provide a higher flux through the armature and a greater magnetic force across the working air gap during opening. Preferably, the friction reducing material can also be non-magnetic to aid the closing time and prevent the armature from sticking.

The closure spring 137 is compressed by the ball member 136 against the spring recess 147 to produce a closure force on the valve member which can be adjusted by turning adjustment screw 132. Torsional winding forces are not generated during adjustment as the pin 140 will turn on the ball member 136 and cause only axial movement of member. Any tendency on the part of the closure spring to wind up will cause slippage against the surface of the ball member and dissipation of the torsional force component.

Allowing fuel to enter a swirl chamber 151 of the valve housing 146 are four tangentially located entry orifices or ports 149. The swirl chamber 151 is defined when the valve 10 is closed by the area between the ball valve 164 and the valve housing bore beginning where the valve seals against seat 150 and ending at its greatest diameter where it interfaces the valve housing bore. When the valve member 151 is in a closed position, the swirl chamber is constrained to a very small volume, generally crescent shaped in cross-section. The residual fuel held in this small area will not substantially affect the spray pattern generation at very small pulse widths.

The configuration including the spherical shape of the ball valve 164, the cylindrical shape of valve housing bore 148, and the conical shape of the valve seat 150 contribute to the provision of a minimum volume swirl chamber. This configuration provides a facile structure where the entry ports can be positioned between the valve seal and the interface at the diameter of the ball valve and valve housing bore 148. The ball valve 164 because of its geometric shape closes the swirl chamber at two places and can be readily manufactured to acceptable tolerances for these interfaces. When the valve is open, the lower spherical surface of the ball valve becomes the top of a larger swirl chamber. This allows the swirl chamber to grow in volume as the injector opens.

In operation, when current in the form of an injection signal from the control unit 18 is supplied to the terminal pins 120 from the connector 12, and thus, to coil 116, a magnetic field is set up through the core member 128, the rear end cap 110, the injector body 100, and the front end cap 106 to attract the soft magnetic material of the armature 158 across the air gap to abut a nonmagnetic shim 135 on the face of the core member. The shim 135 aids the closing time of the valve by maintaining a minimum working air gap during energization.

When the magnetic attraction overcomes the force of the closure spring, the valve member will be lifted away from the valve seat and fuel will be metered by the entry orifices 149 until the current to the terminal pins 120 is terminated and the closure spring force overcomes the collapsing magnetic force to seal the valve once more.

The tangential vorticity imparted to the fuel begins to generate a vortex in the swirl chamber 151 when the valve is open. The swirling fuel is then accelerated by vortex amplification through the conical valve seat and ejected from the valve by means of the wide exit orifice 154.

The entry orifices, which are of controlled diameter for metering, can be precisely sized by ballizing the passageways with a predetermined size of hardened spherical die. As the entry orifices are of a predetermined size, the metering of the fuel is substantially accomplished by the entry orifices and contamination of the exit orifice will not drastically change the static flow rate as in previous valves.

After assembly, the lift and air gap can be adjusted by turning core member 128 and the closure force adjusted by turning adjustment screw 132. The two adjustments will complement each other to calibrate the static and dynamic fuel flow and can thereafter be locked by a potting compound 121.

Returning for an instant to FIG. 1, the spray pattern or angle of fuel of the exhaust flow is a function of the tangential component, $T_c$, of the fuel flow as compared to the axial component, $A_c$, of the fuel flow. The resultant component, $R_c$, will be the direction of fuel spray angle. The width of the angle will depend on the magnitude of the exhaust velocity as measured by resultant component $R_C$. Therefore, maximizing the tangential component $T_c$ and the resultant exhaust velocity will maximize the spray angle A measured from the vertical. Minimizing these parameters will conversely minimize the spray angle A.

With attention now directed to FIG. 3, there is shown cross-sectioned top and side views of an embodiment of the valve housing 146 which has a vortex generating means creating a wide angle spray pattern for injection. In this embodiment a vortex of fuel is generated by four tangentially-located, precisely-sized entry orifices 149*a–d*. The positioning of these entry orifices at the extreme diametral spacing generates a maximum tangential or swirl component in the pressurized fuel as it enters the swirl chamber 151. The tangential velocity of the fluid is then further increased as it travels through the conical valve seat ahead of the exit orifice 154. The conical valve seat, because of the non-extension of the ball valve into the seat area, allows a wide area for vortex amplification.

There are two factors, as illustrated in FIG. 3, which the invention utilizes to control the tangential flow component $T_c$ and the magnitude of the exhaust velocity. The primary factor is input fuel velocity with respect to both magnitude and direction. By varying the diametral spacing, $D_1$, of the entry ports 149*a–d* with respect to the axis A—A of the valve, the tangential versus radial component of the input velocity can be varied, and hence the magnitude of the tangential output component $T_c$, which is directly related thereto. Adjusting the spacing between the spray axis A—A and the axis of the entry port along a diameter perpendicular to the port axis is the same as varying the entry direction of the fuel between tangential (maximum diametral spacing) and radial (minimum diametral spacing).

The magnitude of the input fuel velocity is a function of the cross-sectional area of the entry orifices for a given pressure. Generally, the greater the pressure drop across each entry port, the higher the input velocity will be. This is consistent with the aspect of the invention which provides for the metering of the fuel to be substantially accomplished by the entry ports. Since to obtain a significant pressure drop and high input velocity the ports must be small, a plurality of entry ports are used to generate the desired static flow rate by multiplying the flow for each individual port times the number of ports.

In the preferred embodiment, however, not all of the fuel pressure is dissipated across the entry ports as, according to another aspect of the invention, the static flow rate is controllable by the lift of the valve. Thus, the ball valve and seat interface create a restriction which is adjustable and can be used to adjust the static fuel flow rate. No pressure drop is needed across the exit orifice 154 and a wide exit is used.

It has been determined in a low pressure "bottom feed" injector having an input fuel pressure of approximately 15 PSI that an advantageous configuration is to dissipate most of the pressure across the entry ports, but to allow a pressure drop across the ball valve and seat interface that can be used to vary the static flow rate approximately 10%.

The second factor that influences the tangential component $T_c$ and exhaust velocity is the gain of the vortex amplifier or the conical surface of valve seat 150. By the conservation of momentum, theoretically, as the radius ratio R2/R1 (input compared to output) increases, the tangential velocity component of a non-viscous fluid will increase in a manner functionally related to this ratio. Thus, fuel input into the swirl chamber 151 will have its tangential component amplified. All fuels, however, have viscosity which will provide a damping effect on the vortex amplification which also increases with velocity and radius ratio. Therefore, for a real fluid there is generally some radius ratio of vortex amplifier which will maximize the gain of the vorticity. For a single point valve, such as that illustrated and used for fuel injection, it has been empirically demonstrated such a ratio is approximately 4:1.

With the foregoing in mind, one embodiment of the invention can utilize the ratio of the diameter of the entry orifices to the diameter of the exit orifice to vary the exhaust spray angle. In this embodiment the magnitude of the input velocity can be varied with respect to the gain of the vortex amplifier to regulate the tangential component $T_c$ and axial component $A_c$. Preferably, the input velocity direction is fixed at the maximum diametral spacing.

In another embodiment, the gain of the vortex amplifier is fixed and likewise the magnitude of the input velocity. The tangential component $T_c$ may then be controlled by varying the diametral spacing of the entry orifices to adjust the resultant direction of the input velocity. This, as stated before, directly modifies the ratio of the radial to tangential components of the input velocity.

Another embodiment of the invention for varying the spray angle of the injector is illustrated in FIGS. 5 and 6 which show the injector valve housing 146 in side and top cross-sectional views. The entry orifices 178 and 180 in this embodiment are provided tangential to the vortex amplification means and spaced at a maximum diametral spacing with respect to the swirl chamber. Additionally, two radial entry orifices 184 and 182 are provided to produce a component of fluid entering the injector substantially directed toward the axial center of the exit orifice 154. The spray angle for this embodiment will gain be a function of the ratio between the tangential and radial flow components.

Figure 7:
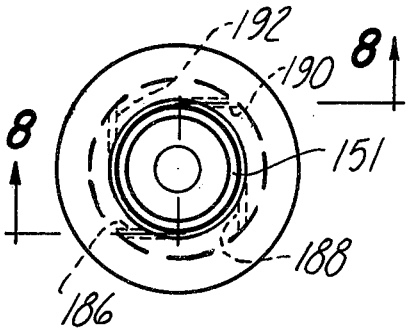
FIGS. 7 and 8 are cross-sectional top and side views, respectively, of an injector valve housing illustrating the fuel entry ports for still another embodiment of the invention.
Figure 8:
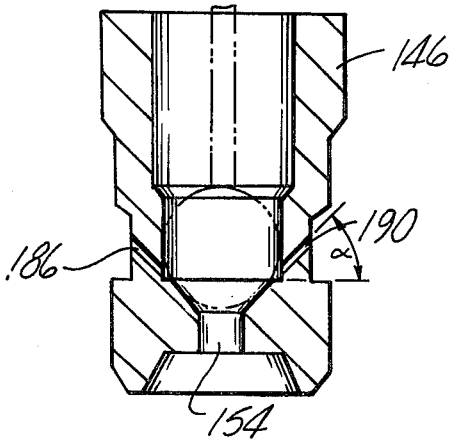

FIGS. 7 and 8 illustrate still another embodiment for changing the spray angle of the injector where cross-sectional top and side views of the injector valve housing 146 are shown. Entry orifices 186,188,190 and 192 are provided tangential to the vortex amplification means but are canted at an angle $\alpha$ from the horizontal to provide a vertical component to the entry of the fuel flow. The vertical offset has the same effect as the mixing of the radial and tangential component flow in the other plane. That is to say, that the spray angle will additionally be a function of the vertical component to the horizontal component.

By any of these methods, or a combination thereof, the spray angle for the injector can be adjusted from nearly a solid, pencil-like stream to a hollow cone spray pattern having an included angle exceeding 90°.

All of the entry orifices illustrated in FIGS. 2—8 can additionally include counterbores on their source side to allow the smooth entry flow of fuel therein. A counterbore will tend to increase the orifice flow coefficient such that higher input velocities with lower pressure drops may be obtained.

Figure 10:
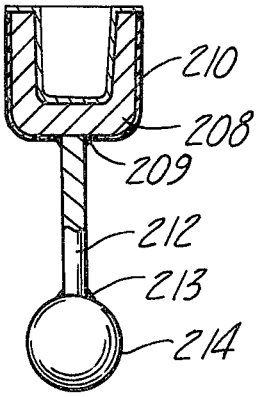
FIGS. 9 and 10 are cross-sectional side views of alternate embodiments of the valve member of the fuel injector illustrated in FIG. 2.
Figure 9:
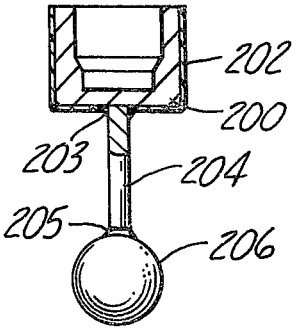

Alternate embodiments of the valve member 159 are illustrated in FIGS. 9 and 10 where each generally comprises a generally cup-shaped armature means connected by means of a flexible stem member to a ball valve. In FIG. 9 an armature means 200, which is machined from bar stock of a magnetic material, is overlayered with a friction reducing material 202. The armature means 200 is thereafter connected to a flexible stem member 204 which in turn is connected to valve 206 to form a valve member. The connections are preferably made by resistance welds 203 and 205.

Likewise, in FIG. 10, an armature means 208 is connected to a flexible stem member 212 which is connected to a ball valve 214 by means of resistance welds 209 and 213, respectively. The armature means 210 in this embodiment is stamped from a sheet into the cup-shape and thereafter coated with a friction reducing material 210. It is noted in this embodiment that the friction reducing material 210 overlayers the armature where it will contact the core member 128 (FIG. 2). Choosing the material 210 for this implementation to be non-magnetic will eliminate the need for the non-magnetic shim 135.

The layer of friction reducing material described for the various preferred embodiments throughout the specification may be selected from the group comprising TEFLON, electroless nickel, copper with a nickel or tin overcoat, or similar materials.

While the preferred embodiments of the invention have been shown, it will be obvious to those skilled in the art that modification and changes may be made to the disclosed system without departing from the spirit and scope of the invention as defined by the appended claims.

What is claimed is:

1. An electromagnetic fuel injector having an energizable stator means for controlling the movement of a valve member of a valve assembly to open and close the injector and thereby meter fuel, said valve assembly comprising:

a valve housing including a valve housing bore terminating with a valve seat which is connected to an exit orifice;

a valve member including a ball valve connected by a flexible stem to an armature means and is reciprocally located in said valve housing bore, operable to obturate said exit orifice by sealing said valve seat with said ball valve, said ball valve having a diameter substantially equivalent to said valve housing bore such that a housing interface is formed;

a swirl chamber being defined when the injector is closed by the volume included between said ball valve and said valve housing bore for imparting to the fuel flow exhausted from the exit orifice a swirl component that is tangential with respect to the spray axis of the injector; and means for supplying fuel from a pressurized source to said swirl chamber including at least one entry metering orifice of a predetermined size communicating fuel between said source and said swirl chamber and positioned between said housing interface and said valve seat.

2. An electromagnetic fuel injector as defined in claim 1 wherein said swirl chamber volume, initiated at the housing interface and terminated at the interface between said ball valve and said valve seat, being minimized when the injector is closed to produce a minimal residuum of fuel therein.

3. An electromagnetic fuel injector as defined in claim 2 wherein said injector further includes:

vortex amplification means connected to said swirl chamber for increasing said swirl component by the gain of said vortex amplification means.

4. An electromagnetic fuel injector as defined in claim 3 wherein:

said vortex amplification means includes said valve seat and said valve seat is a truncated cone.

5. An electromagnetic fuel injector as defined in claim 4 wherein:

the gain of said vortex amplification means is dependent upon the ratio of the input diameter of said valve seat as compared to the output diameter of said valve seat.

6. An electromagnetic fuel injector as defined in claim 5 wherein:

said entry orifice is positioned at a maximum diametral spacing respect to said swirl chamber, and said tangential swirl component is adjusted by sizing said orifice with respect to said output diameter of said valve seat.

7. An electromagnetic fuel injector as defined in claim 6 wherein:

said tangential swirl component is adjusted by positioning said orifice along the diametral spacing of the swirl chamber.

8. An electromagnetic fuel injector as defined in claim 7 wherein said injector further includes:

at least one radial entry orifice directed toward the injector spray axis providing fluid communication between said source and said swirl chamber, said radial orifice providing a radial fuel flow which imparts an axial components from the exit orifice, said swirl component being controlled by the ratio of the size of said tangential entry orifice to said radial entry orifice.

9. An electromagnetic fuel injector as defined in claim 6, claim 7, or claim 8 wherein:

at least one entry orifice is canted at an angle to the horizontal such that vertical and horizontal input components of fuel flow are developed, wherein said swirl component is generated as a function of the ratio of said vertical and horizontal input components.

10. An electromagnetic fuel injector having an energizable stator means for controlling the movement of a valve member of a valve assembly to open and close the injector and thereby meter fuel, said valve assembly comprising:

a valve housing including a valve housing bore terminating with a valve seat which is connected to an exit orifice;

a self-seating valve member including a cup-shaped armature means connected by a flexible stem member to a semispherical sealing surface, reciprocally located in said valve housing bore, and operable to obturate said exit orifice by sealing said valve seat with sealing surface;

a closure spring mounted in said cup-shaped armature for producing a closure force to bias said semispherical sealing surface against said valve seat, said closure spring further maintaining an air gap between said armature and the stator means;

first means for adjusting said air gap;

second means for adjusting said closure force provided by said closure spring, said first and second means being complimentary and independently operable to calibrate static and dynamic fuel flow from said exit orifice;

a swirl chamber having a volume being defined as the space between said semipherical sealing surface and said valve seat when the injector is closed and adapted to impart a swirl component to the fuel exhausted from the exit orifice when the injector is open and to retain a minimal residuum of fuel therein when the injector is closed; and means for supplying fuel from a pressurized source to said swirl chamber including at least one entry metering orifice positioned between said semispherical sealing surface and said valve seat for tangentially directing, with respect to the spray axis of the injector, a predetermined quantity of fuel into said exit orifice when said valve member and said valve seat are in an open relationship.

11. An electromagnetic fuel injector having an energizable stator means for controlling the movement of a valve member of a valve assembly to open and close the injector and thereby meter fuel, said valve assembly comprising:

a valve housing including a valve housing bore terminating with a valve seat which is connected to an exit orifice;

a self-seating valve member having an armature means connected by a flexible stem to a semispherical sealing surface, reciprocally located in said valve housing bore, and operable to obturate said exit orifice by sealing said valve seat with said sealing surface;

an armature guide means on the stator means for slideably contacting said armature means during reciprocation;

means for maintaining a predetermined air gap between said armature means and said armature guide means for maximizing the magnetic flux and minimizing the sliding resistance therebetween, said air gap means including a non-magnetic friction reducing material on one of said armature means and said armature guide means;

a swirl chamber having a volume being defined as the space between said semipherical sealing surface and said valve seat when the injector is closed and adapted to impart a swirl component to the fuel exhausted from the exit orifice when the injector is open and to retain a minimal residuum of fuel therein when the injector is closed; and means for supplying fuel from a pressurized source to said swirl chamber including at least one entry metering orifice positioned proximate to the interface of said semispherical sealing surface and said valve seat for tangentially directing with respect to the spray axis of the injector a predetermined quantity of fuel into said exit orifice when said valve member and said valve seat are in an open relationship.

* * * * *